US011781315B1

(12) United States Patent
Zhou et al.

(10) Patent No.: US 11,781,315 B1
(45) Date of Patent: Oct. 10, 2023

(54) MODULAR WALL ASSEMBLY WITH PREFABRICATED WIRES

(71) Applicant: A&C Future, Inc, Newport Beach, CA (US)

(72) Inventors: Zhuangboyu Zhou, Santa Ana, CA (US); Keguan Zou, Irvine, CA (US); Han Qin, Newport Beach, CA (US); Jiuqi Wang, Tustin, CA (US); Sichen Li, Irvine, CA (US); Jiayang Qin, Newport Beach, CA (US)

(73) Assignee: A&C Future Inc

( * ) Notice: Subject to any disclaimer, the term of this patent is extended or adjusted under 35 U.S.C. 154(b) by 0 days.

(21) Appl. No.: 17/859,999

(22) Filed: Jul. 7, 2022

(51) Int. Cl.

| | |
|---|---|
| ***E04B 2/74*** | (2006.01) |
| ***E04B 2/00*** | (2006.01) |
| ***E04C 2/52*** | (2006.01) |
| ***E04B 2/56*** | (2006.01) |
| ***E04B 1/02*** | (2006.01) |
| *E04C 2/00* | (2006.01) |

(52) U.S. Cl.
CPC ..... *E04B 2/74* (2013.01); *E04B 1/02* (2013.01); *E04B 2/56* (2013.01); *E04C 2/46* (2013.01); *E04C 2/52* (2013.01); *E04C 2/521* (2013.01); *E04B 2002/7488* (2013.01); *E04C 2002/001* (2013.01)

(58) Field of Classification Search
CPC ..... E04B 1/02; E04B 2/56; E04B 2/74; E04B 2002/7488; E04C 2/46; E04C 2/52; E04C 2/521; E04C 2002/001
See application file for complete search history.

(56) References Cited

U.S. PATENT DOCUMENTS

| | | | | |
|---|---|---|---|---|
| 5,214,889 | A * | 6/1993 | Nienhuis | E04B 2/7438 52/239 |
| 5,396,750 | A * | 3/1995 | Kleyn | E04C 2/521 D25/138 |
| 9,455,561 | B2 * | 9/2016 | Welch | A61K 39/08 |
| 10,273,687 | B1 * | 4/2019 | Walker | H01R 25/006 |
| 2010/0263308 | A1 * | 10/2010 | Olvera | E04C 2/521 52/220.2 |
| 2016/0168863 | A1 * | 6/2016 | Kwan | E04F 13/0805 52/36.5 |
| 2018/0340326 | A1 * | 11/2018 | Pirrung | E04H 1/02 |

(Continued)

FOREIGN PATENT DOCUMENTS

CN 113914506 A * 1/2022

*Primary Examiner* — Jessie T Fonseca
(74) *Attorney, Agent, or Firm* — Fei Hung Yang

(57) ABSTRACT

The present invention provides a modular wall assembly with prefabricated wires, comprising: a base and multiple modular wall frames. The base is provided with wires and extends out of the base, and at least one connecting groove and a plurality of convex rings are fixed on the base, and the connecting groove is provided with a plurality of conducting parts, and the conducting parts are in electrical communication with wires in the base. The modular wall frames are provided with wires, and comprising: at least one connecting stud, at least one upper connecting groove, a plurality of upper convex rings, a plurality of lower grooves, and a locking device. Through those structure, the workers can quickly build a wall with strength not much different from a normal wall, while also setting up the indoor devices by using the prefabricated wires in the modular wall frame.

11 Claims, 9 Drawing Sheets

(56) References Cited

U.S. PATENT DOCUMENTS

| | | | | |
|---|---|---|---|---|
| 2019/0040630 | A1* | 2/2019 | Piethman | E04B 2/7425 |
| 2020/0240141 | A1* | 7/2020 | Strickland | E04C 2/384 |
| 2021/0246652 | A1* | 8/2021 | May | E04C 2/388 |
| 2021/0404183 | A1* | 12/2021 | May | E04B 2/58 |

* cited by examiner

MODULAR WALL ASSEMBLY WITH PREFABRICATED WIRES

FIELD OF THE INVENTION

The present invention relates generally to a modular wall assembly with prefabricated wires, and more particularly, the present invention effectively improves the traditional wall building process by optimizing the construction process to shorten the wall building time and while in the wall construction process, the indoor devices can also be set up by using the prefabricated wires to also make the indoor decoration part easy.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the housing industry, the process of building a home is tedious and time-consuming, and in the construction process, the wall building process is an important part. The traditional way of wall-building process exists a lot of problems. The cost of materials is various which leads to huge transportation costs, and materials also have a storage problem. It takes a relatively wide area for storage of the sands or any other construction materials. On another hand, the traditional wall-building process is complicated. It has a long construction period, and this tedious process will bring high labor costs. When the wall has been built, the wiring will be another large construction process. For some concrete walls, people must notch before wiring, and it increases labor and wastes many sources. After all, the indoor design will be another part that consume a lot of time setting up. Therefore, the furniture, electric device, and other household supplies will be hard to deal with while building the wall. It will be costly to finish the entire building with everything set up.

Therefore, how to quickly and efficiently reduce the time for making walls and setting up the indoor devices when building a house is the main problem that the applicant wants to solve.

SUMMARY

In order to solve the problem above, the present invention redefines the way of building walls by improving the traditional method of building walls. In this invention, a multi-function modular wall is designed to increase the construction process. The prefabricated wall has been set for customization functions. For example, the wall module can be set for light, speakers, air-conditioner, and so on. The wire is preset for all the electric devices. Then module and module will be connected directly. Connections between each module will not only fix the wall modules together but also let the circuits merge into the mainline.

It is therefore an object of the present invention to provide wall frames for building walls that can be mass-produced in a factory by a manufacturer.

It is another object of the present invention to provide a new way of processing house walls.

It is yet another object of the present invention to provide an improved traditional way of building houses, thereby increasing the efficiency of building houses.

It is another object of the present invention to provide a design that improves setting up the indoor devices by using the prefabricated wires in the modular wall frame.

To achieve the objects above, the present invention provides a modular wall assembly with prefabricated wires, comprising:

a base, which is provided with wires and extends out of the base, and at least one connecting groove and a plurality of convex rings are fixed on the base, and the connecting groove is provided with a plurality of conducting parts, and the conducting parts are in electrical communication with wires in the base; and multiple modular wall frames, each of the modular wall frames is provided with wires, and the modular wall frame comprising:

at least one connecting stud, which is provided on the bottom surface of the modular wall frame, and is provided with a plurality of lower conducting parts, and the lower conducting parts are in electrical communication with the wires in the modular wall frame;

at least one upper connecting groove, which is provided on the top surface of the modular wall frame and is provided with a plurality of upper conducting parts which are in electrical communication with the wires in the modular wall frame;

a plurality of upper convex rings, which are attached to the top surface of the modular wall frame;

a plurality of lower grooves, which correspond to the upper convex rings and are arranged on the bottom surface of the modular wall frame, and one side of the lower grooves is provided with a deep hole and the other side is symmetrically provided with a shallow hole; and a locking device, which is arranged in the bottom of the modular wall frame, and the locking device has a plurality of locking blocks, a transmission lever and an operating lever; the locking blocks correspond to the convex rings or the upper convex rings and are disposed in the deep holes, and each of the locking blocks extends upward with a connecting portion, and the connecting portion is provided with a first thread; the transmission lever is attached above the lock blocks, and is provided with a plurality of second threads corresponding to the first threads, so as to drive the lock blocks to perform linear motion through screw drive, and then inserted into the shallow holes after passing through the convex rings or the upper convex rings; the operating lever is connected with the transmission lever through gears for driving the transmission lever to rotate;

wherein, when one of the modular wall frame and the base is connected to each other, the connecting stud is placed in the connecting groove for the conducting parts and the lower conducting parts to be in electrical communication, thereby making the wires in the base electrically communicate with the wires in the modular wall frame, and the convex rings are inserted into the lower grooves for the locking blocks to fix the convex rings in the lower grooves after the operating lever is rotated, so that the modular wall frame is fixed on the base;

wherein, when one of the modular wall frames and the other one of the modular wall frames are connected to each other, the connecting stud is placed in the upper connecting groove for the upper conducting parts and the lower conducting parts to be electrically connected, and then make the wires in the modular wall frame electrically communicate with the wires in the other modular wall frame, and the upper convex rings are inserted into the lower grooves for the locking blocks to fix the upper convex rings in the lower grooves after the operating lever is rotated, so that the modular wall frame is fixed to the other modular wall frame.

In another aspect, wherein both ends of the bottom surface of the modular wall frames are provided with an auxiliary connectors respectively, and both ends of the top surface of the modular wall frames are respectively provided with an upper auxiliary connecting groove corresponding to the auxiliary connectors, and both ends of the base are also provided with an auxiliary connection groove corresponding to the auxiliary connectors, so as to assist the connection of any of the modular wall frames to the base and the connection of the modular wall frames.

In another aspect, wherein the auxiliary connectors are rollers, and one end of the upper auxiliary connecting grooves and one end of the auxiliary connecting grooves are provided with a recess respectively for placing the auxiliary connectors.

In another aspect, wherein the modular wall frames are provided with at least one pillar, the two ends of the pillar are respectively connected to the top and the bottom of the modular wall frames, so as to allow the wires in the modular wall frames to connect to the lower conducting parts and the upper conducting parts.

In another aspect, wherein the pillar is provided with an electrical contact hole which is in electrical communication with the wires in the modular wall frame for installing other electrical appliances at the modular wall frame.

In another aspect, wherein the transmission lever and the operating lever are arranged perpendicular to each other.

In another aspect, wherein the modular wall frames are provided with fillers.

In another aspect, wherein the base is screwed to floor.

In another aspect, the present invention further comprising a cover plate for covering the top of any one of the modular wall frames.

In another aspect, wherein the cover plate is screwed to ceiling.

In another aspect, the present invention further comprising shielding plates for enclosing the modular wall frames.

In the present invention, the entire wall will only have one input at the base, which is easy to connect with the wiring system from the beam and column frame, and one output in each modular wall frame, which is for builder or user to connect with the indoor devices. Furthermore, the wall module is designed as a hollow box with studs supporting the structure. The output inside the box that can supply different electric devices, then the devices will be set inside the box with a specially designed cover. After everything has been set in the factory, depending on customization, people will only need to assemble the wall during construction. Time for these processes will be shortcutter a lot compared to the traditional method.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
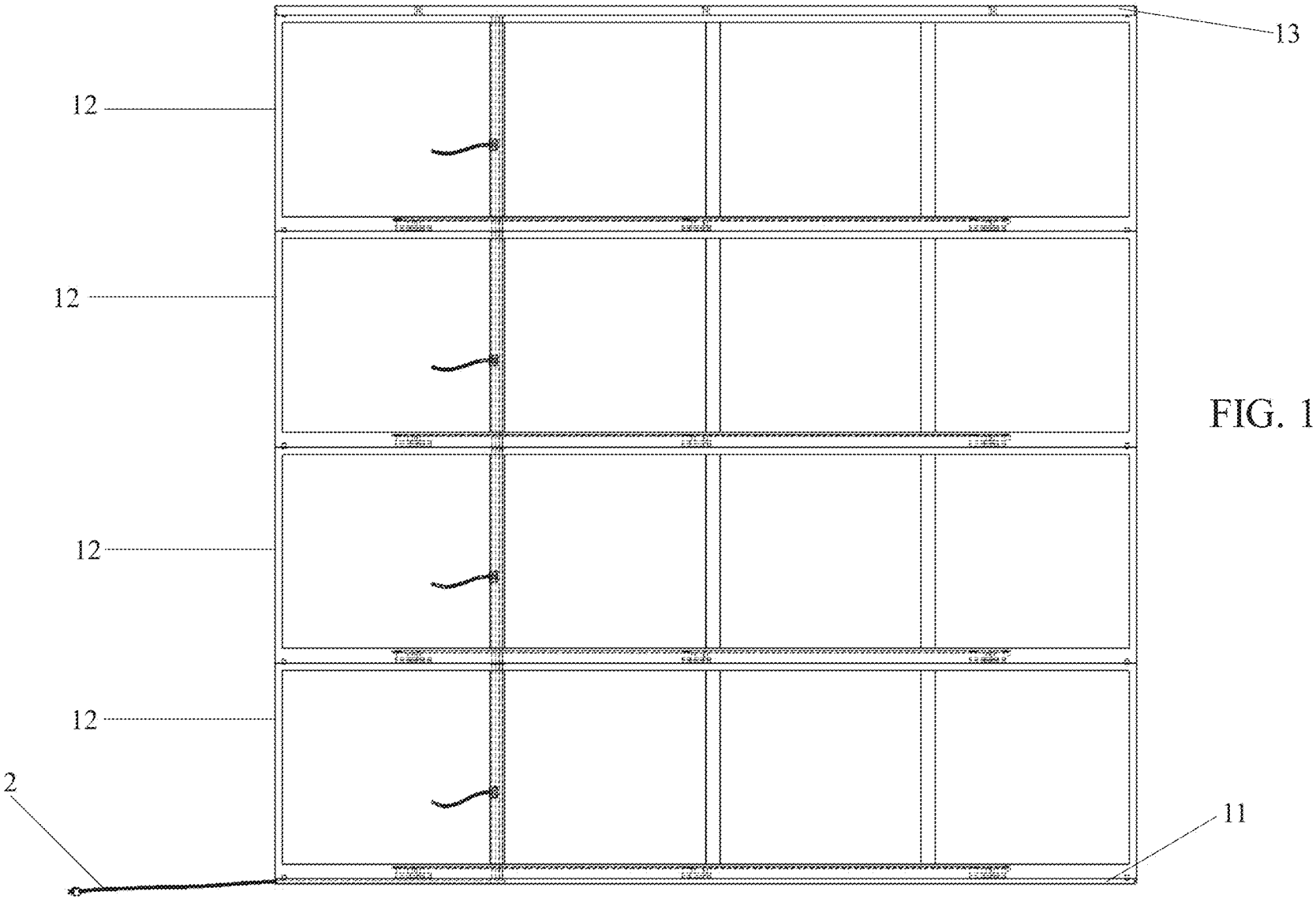
FIG. 1 illustrates the plain view of a modular wall assembly with prefabricated wires.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Please refer to FIGS. 1~8, they show the schematic view and perspective view of the components that is needed to build the present invention. The modular wall assembly 1 with prefabricated wires 2, comprising: a base 11 and multiple modular wall frames 12. The base 11 is provided with wires 2 and extends out of the base 11, and at least one connecting groove 111 and a plurality of convex rings 112 are fixed on the base 11, and the connecting groove 111 is provided with a plurality of conducting parts 1111, and the conducting parts 1111 are in electrical communication with wires 2 in the base 11.

In detail, the modular wall frames 12 are provided with wires 2, and comprising: at least one connecting stud 121, at least one upper connecting groove 122, a plurality of upper convex rings 123, a plurality of lower grooves 124, and a locking device 125. The connecting stud 121 is provided on the bottom surface of the modular wall frame 12, and is provided with a plurality of lower conducting parts 1211, and the lower conducting parts 1211 are in electrical communication with the wires 2 in the modular wall frame 12. The upper connecting groove 122 is provided on the top surface of the modular wall frame 12 and is provided with a plurality of upper conducting parts 1211 which are in electrical communication with the wires 2 in the modular wall frame 12. The upper convex rings 123 are attached to the top surface of the modular wall frame 12. The lower grooves 124 correspond to the upper convex rings 123 and are arranged on the bottom surface of the modular wall frame 12, and one side of the lower grooves 124 is provided with a deep hole 1241 and the other side is symmetrically provided with a shallow hole 1242. The locking device 125 is arranged in the bottom of the modular wall frame 12, and the locking device 125 has a plurality of locking blocks 1251, a transmission lever 1252 and an operating lever 1253; the locking blocks 1251 correspond to the convex rings 112 or the upper convex rings 123 and are disposed in the deep holes 1241, and each of the locking blocks 1251 extends upward with a connecting portion 12511, and the connecting portion 12511 is provided with a first thread 12512; the transmission lever 1252 is attached above the locking blocks 1251, and is provided with a plurality of second threads 12521 corresponding to the first threads 12512, so as to drive the locking blocks 1251 to perform linear motion through screw drive, and then inserted into the shallow holes 1242 after passing through the convex rings 112 or the upper convex rings 123; the operating lever 1253 is connected with the transmission lever 1252 through gears 1254 for driving the transmission lever 1252 to rotate.

While in use, when one of the modular wall frame 12 and the base 11 is connected to each other, the connecting stud 121 is placed in the connecting groove 111 for the conducting parts 1111 and the lower conducting parts 1211 to be in electrical communication, thereby making the wires 2 in the base 11 electrically communicate with the wires 2 in the modular wall frame 12, and the convex rings 112 are inserted into the lower grooves 124 for the locking blocks 1251 to fix the convex rings 112 in the lower grooves 124 after the operating lever 1253 is rotated, so that the modular wall frame 12 is fixed on the base 11. In addition, when one of the modular wall frames 12 and the other one of the modular wall frames 12 are connected to each other, the connecting stud 121 is placed in the upper connecting groove 122 for the upper conducting parts 1221 and the lower conducting parts 1211 to be electrically connected, and then make the wires 2 in the modular wall frame 12 electrically communicate with the wires 2 in the other modular wall frame 12, and the upper convex rings 123 are inserted into the lower grooves 124 for the locking blocks 1251 to fix the upper convex rings 123 in the lower grooves 124 after the operating lever 1253 is rotated, so that the modular wall frame 12 is fixed to the other modular wall frame 12.

Figure 2:
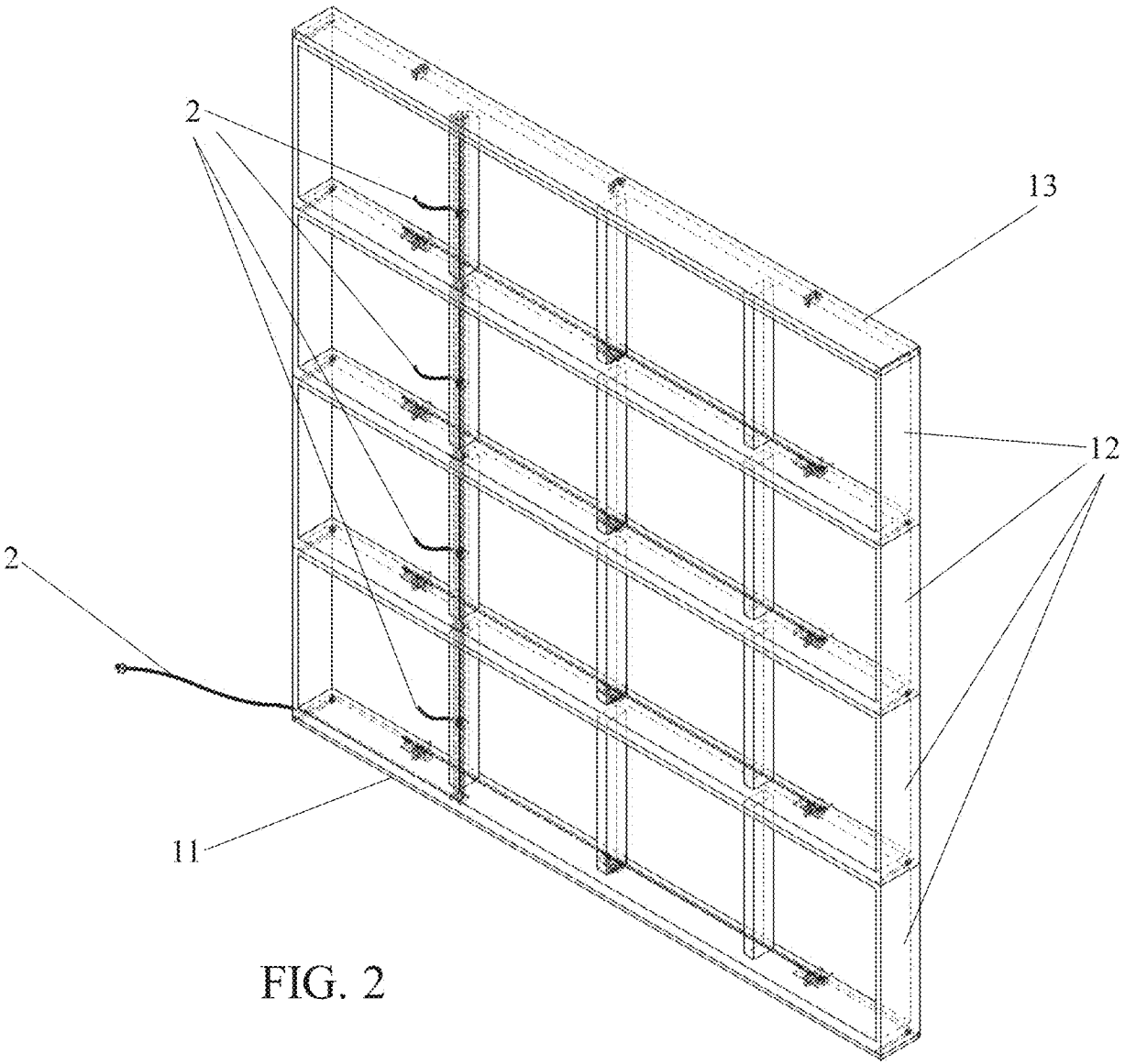
FIG. 2 illustrates the perspective view of the modular wall assembly with prefabricated wires.
Figure 3:
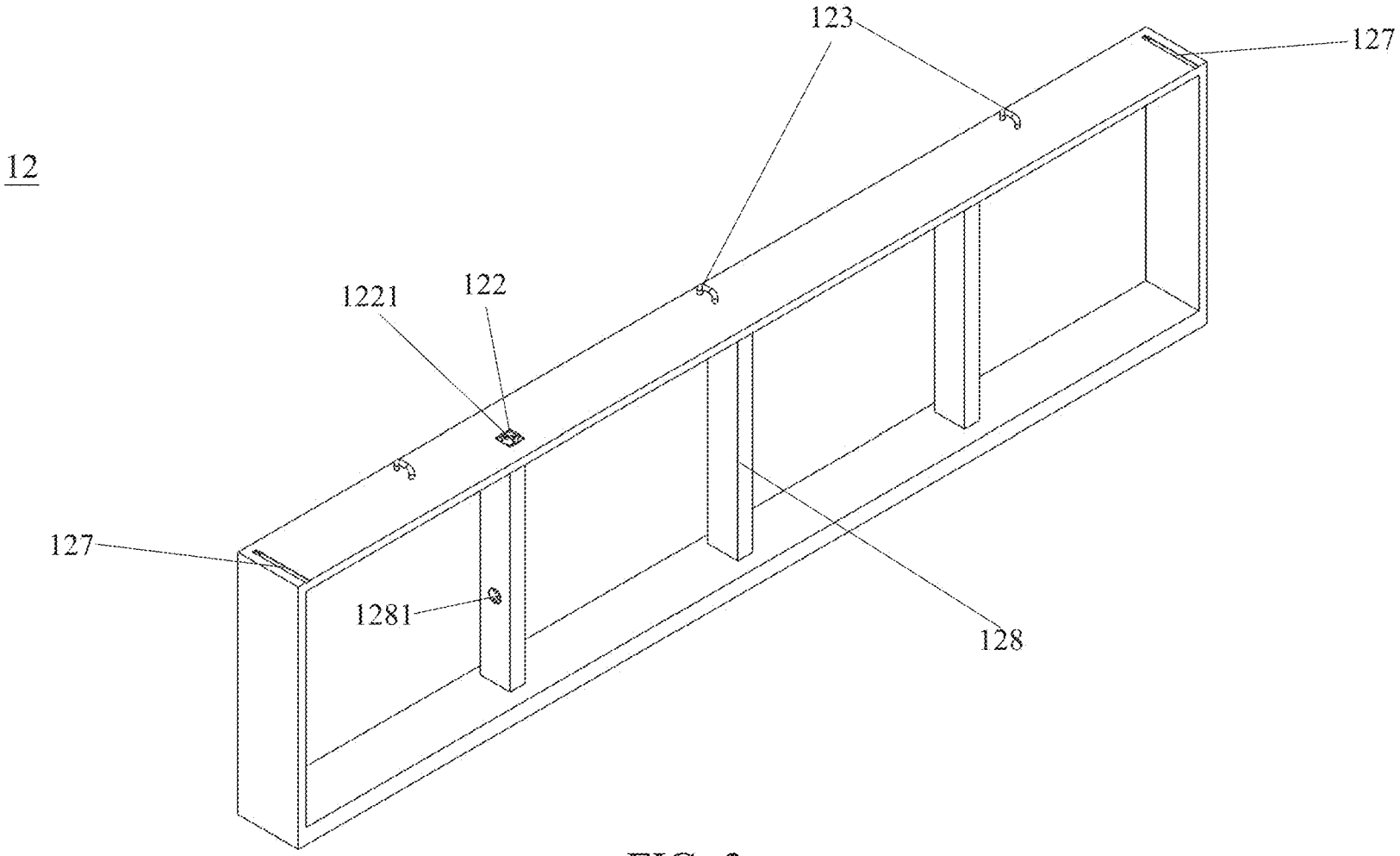
FIG. 3 shows the schematic view of the modular wall frame.
Figure 4:
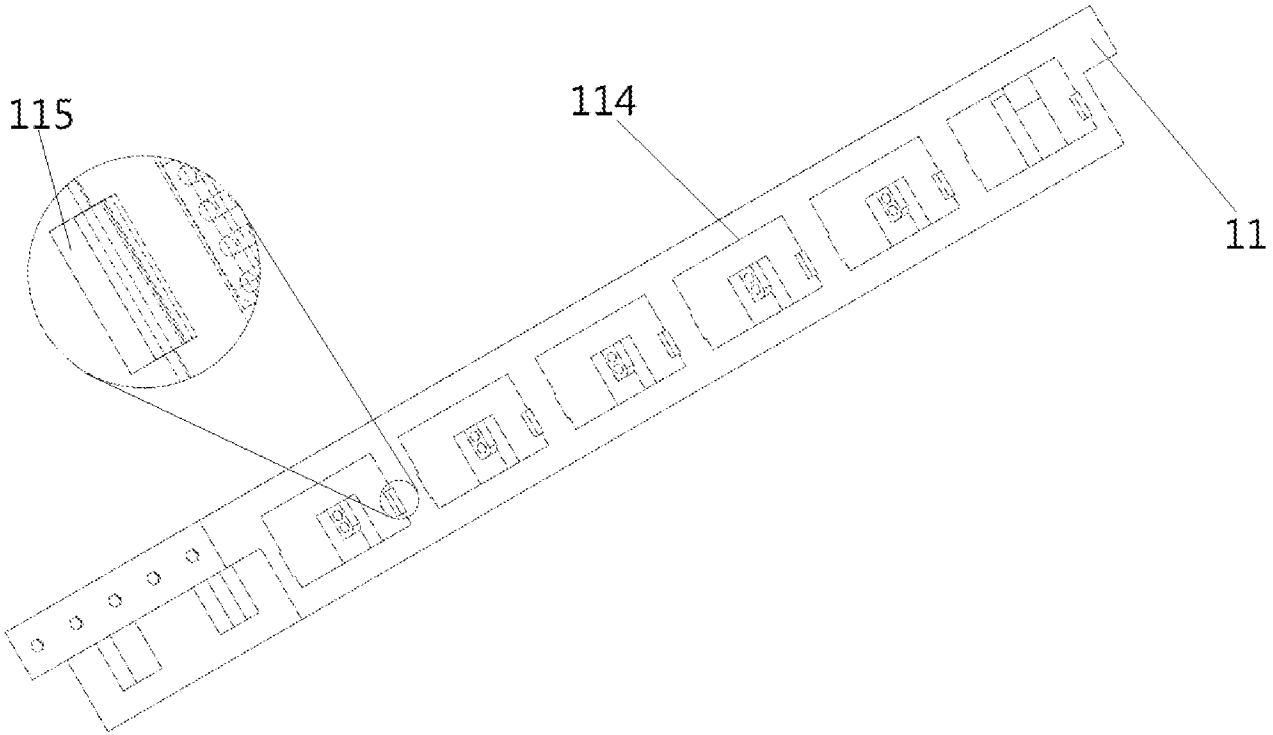
FIG. 4 shows the perspective view of the modular wall frame.
Figure 5:
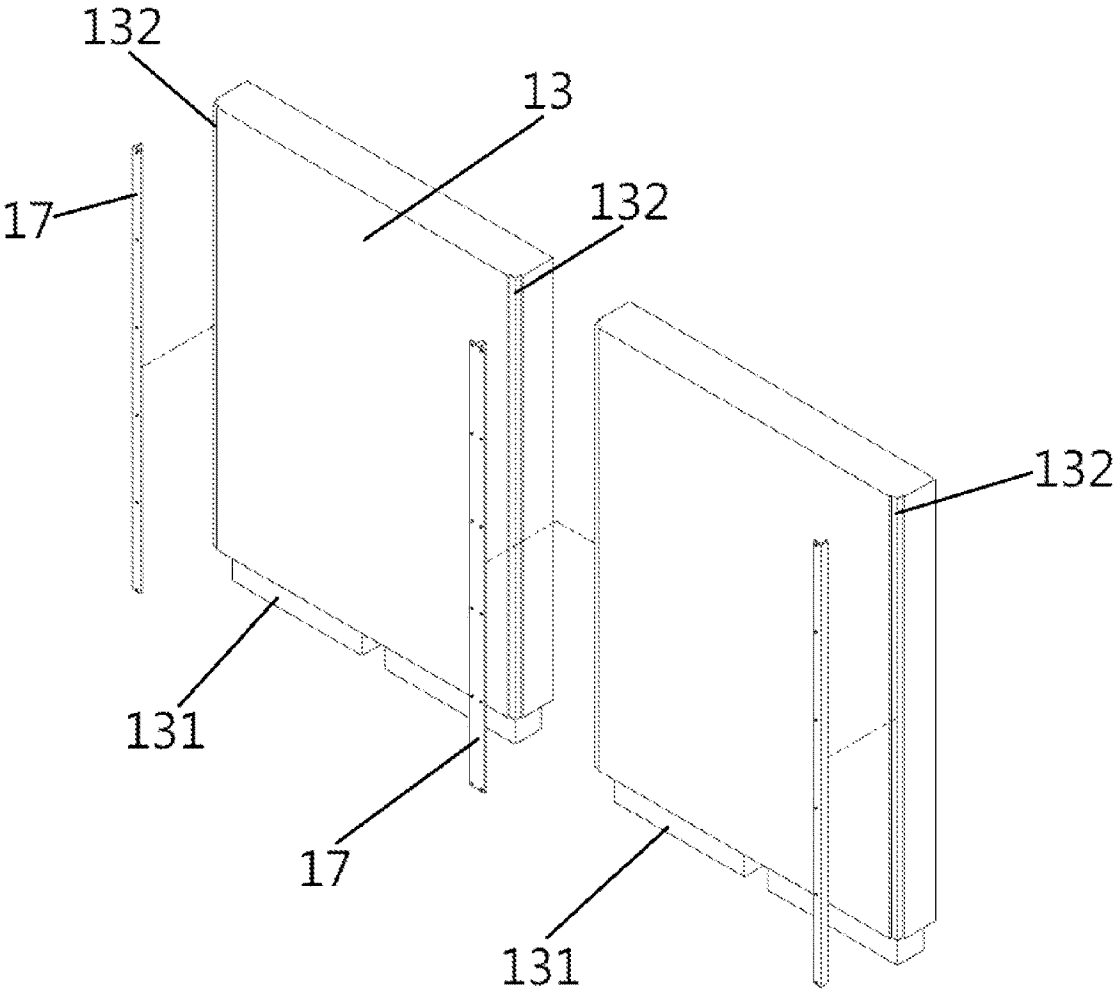
FIG. 5 demonstrates the enlarged view of the locking device in the modular wall frame.
Figure 6:
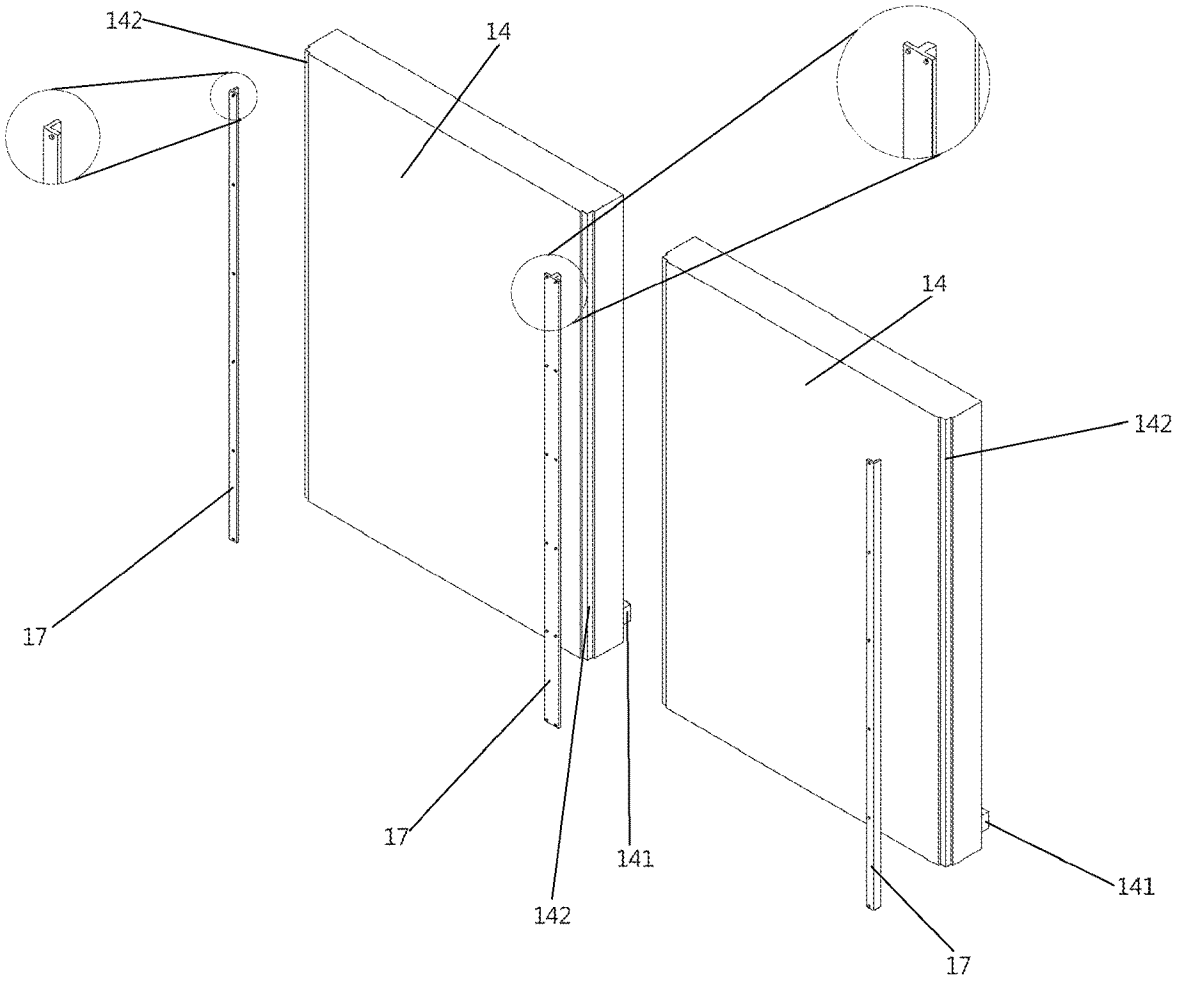
FIG. 6 shows the schematic view of the locking device.
Figure 8:
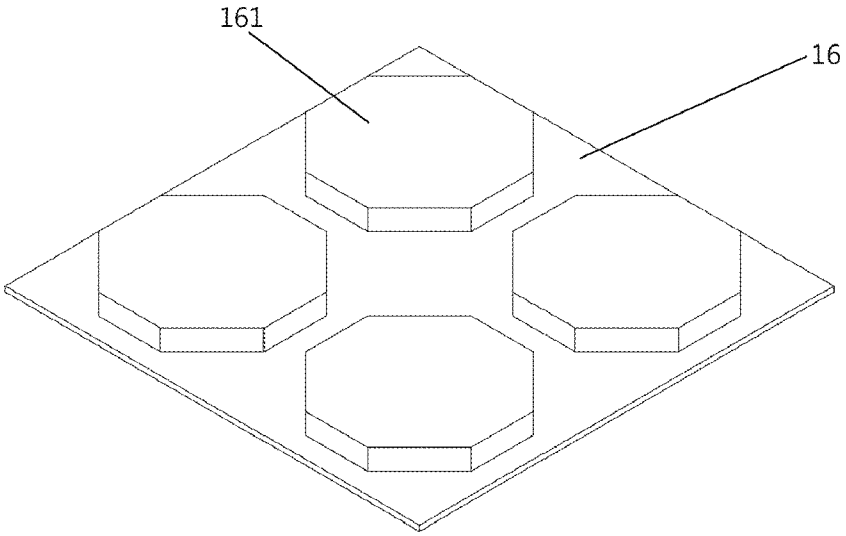
FIG. 8 illustrates schematic view of the base.
Figure 7:
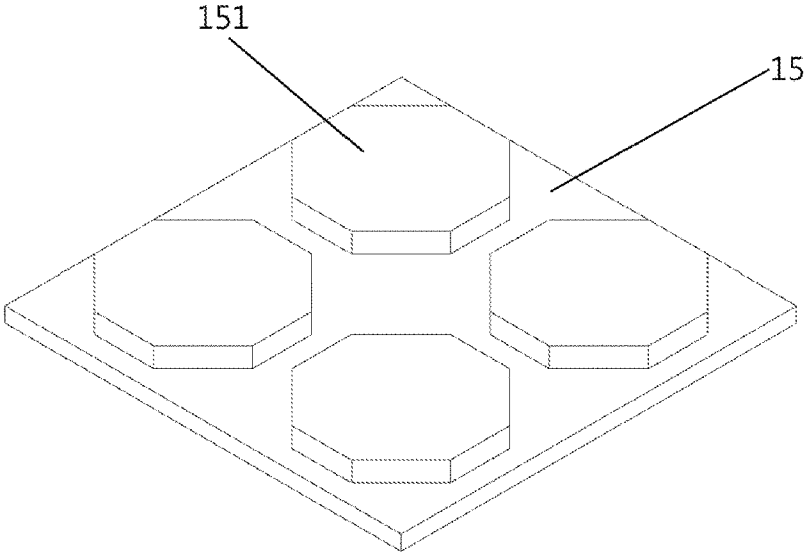
FIG. 7 shows partial views of the modular wall frame.

Through the above-mentioned locking device 125, the modular wall frames 12 and the base 11 can be stably joined to each other without being easily separated, thereby enhancing the durability of the present invention, just like the locked state shown in FIG. 2. In addition, the operating lever 1253 can be operated by hand rotation, or the operating lever 1253 can be rotated by a flathead screwdriver or other tools by means of a flat groove on the operating lever 1253. The latter is also designed so that the operating lever 1253 does not protrude from the wall 1, making the present invention more aesthetically pleasing without compromising its functionality. In this embodiment, the transmission lever 1252 and the operating lever 1253 are arranged perpendicular to each other, which makes the locking device 125 easier to operate. In addition, the connections between the connecting stud 121 and the connecting groove 111 and between the modular wall frames 12 and the base 11 can be smoothly connected to each other, so that each of the modular wall frames 12 has their own wires 2 that are available, and it is more convenient for users or workers to install electrical equipment on the wall.

In addition, in this embodiment, both ends of the bottom surface of the modular wall frames 12 are provided with an auxiliary connectors 126 respectively, and both ends of the top surface of the modular wall frames 12 are respectively provided with an upper auxiliary connecting groove 127 corresponding to the auxiliary connectors 126, and both ends of the base 11 are also provided with an auxiliary connection groove 113 corresponding to the auxiliary connectors 126, so as to assist the connection of any of the modular wall frames 12 to the base 11 and the connection of the modular wall frames 12. In this way, the modular wall frames 12 and the base 11 join with each other more smoothly. And specifically, the auxiliary connectors 126 can be rollers, and one end of the upper auxiliary connecting grooves 127 and one end of the auxiliary connecting grooves 113 are provided with a recess (1131, 1271) respectively for placing the rollers, to allow the modular wall frames 12 to slide to other the modular wall frames 12 or the base 11, thus reducing the burden on the installer. The auxiliary connectors 126 and the auxiliary connecting grooves 113 (or the upper auxiliary connecting grooves 127) can also be connected in other ways, such as the design of the chute and the slider, but not limited to this.

On the relevant configuration of the wires 2, the modular wall frames 12 are provided with at least one pillar 128, the two ends of the pillar 128 are respectively connected to the top and the bottom of the modular wall frames 12, so as to allow the wires 2 in the modular wall frames 12 to connect to the lower conducting parts 1211 and the upper conducting parts 1221. Furthermore, the pillar 128 is provided with an electrical contact hole 1281 which is in electrical communication with the wires 2 in the modular wall frame 12 for installing other electrical appliances at the modular wall frame 12. This allows wires 2 to be available in each of the modular wall frames 12.

In terms of installation, the base 11 is screwed to floor, and the present invention further comprises a cover plate 13 for covering the top of any one of the modular wall frames 12, and the cover plate 13 is screwed to ceiling. Once the base 11 and the cover plate 13 are set, the modular wall frames 12 in the middle are able to build a complete wall 1 according to the positioning points that have been set, thereby reducing construction time.

Figure 9:
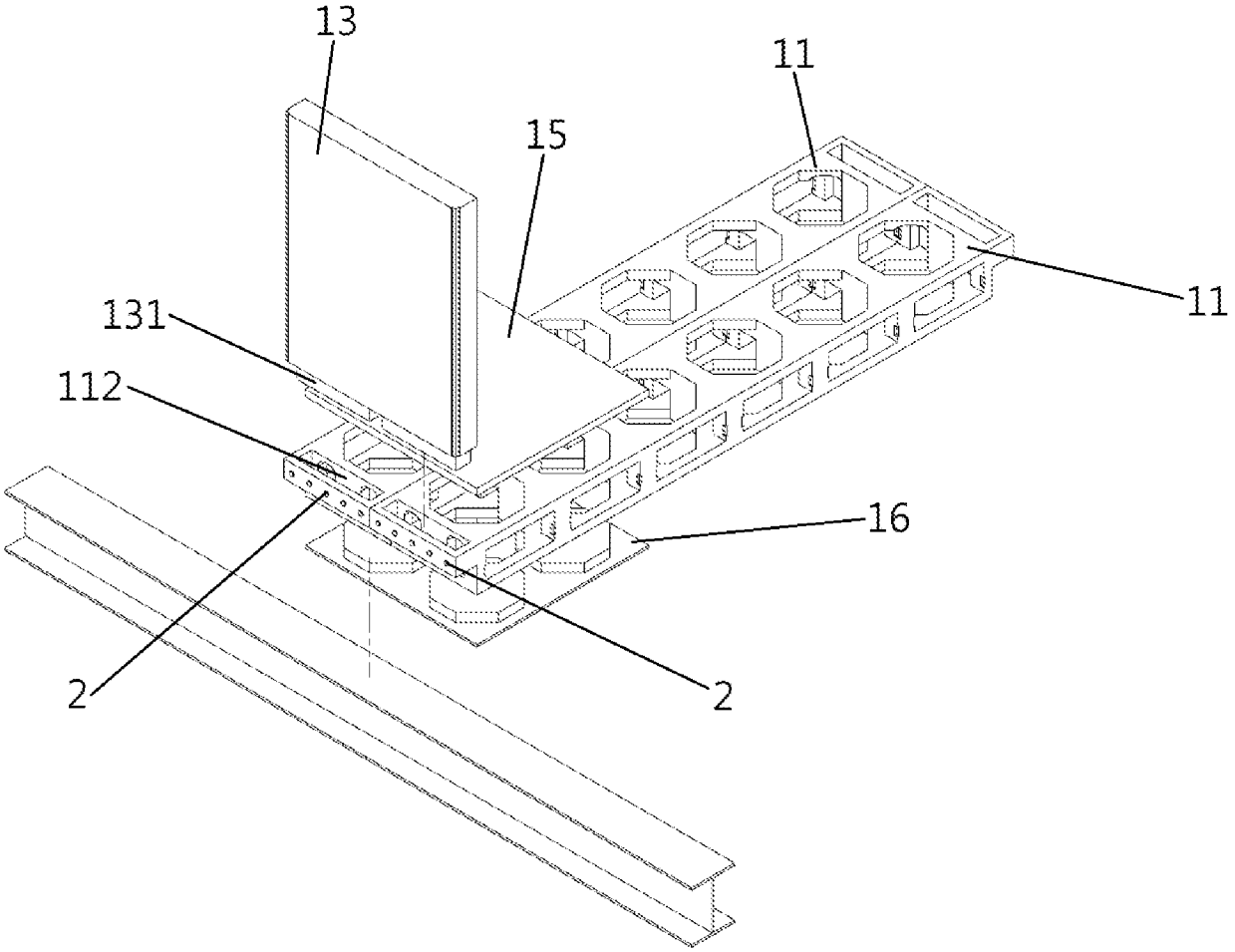
FIG. 9 illustrates the schematic view of complete wall assembly.

Please refer to FIG. 9, it illustrates the schematic view of complete wall assembly 1 and gives an overview of the multifunction modular wall system. The wall assembly 1 has preset with some furniture and devices in daily life use. As in this example, the wall 1 includes a light module, a monitor module, a speaker module, and a heating module. The wall 1 is assembled by piling all the wall modules up and locked by pushing in tightly. The components of the wall assembly 1 are prefabricated in a factory and are transported to the construction individually and assembled for the wall assembly 1. Since there are mechanisms connection between each wall module, the entire wall will only need to be fixed with beams at the top or fixed columns on both sides to resist the horizontal load. Methods are not restricted to bolt, nail, weld, and so on. Furthermore, there are shielding plates (501~504) for enclosing the modular wall frames 12, and can be different depends on the uses. The shielding plate 501 is for the light wall module. It leaves a long narrow rectangular space for setting the light. And the shielding plate 502 is for the monitor module, that is, there is a monitor-size space in the middle of the wall. The monitor will be pinned on the studs, and the front face of the monitor will be shown to people. The shielding plate 503 is for the speaker module, they will be of different sizes depending on different kinds of speakers. The shielding plate 504 is the cover of the heating module, and the number of cracks will differ for outlet flow. Of course, the shielding plates (501~504) are not limited to these uses.

Figure 10:
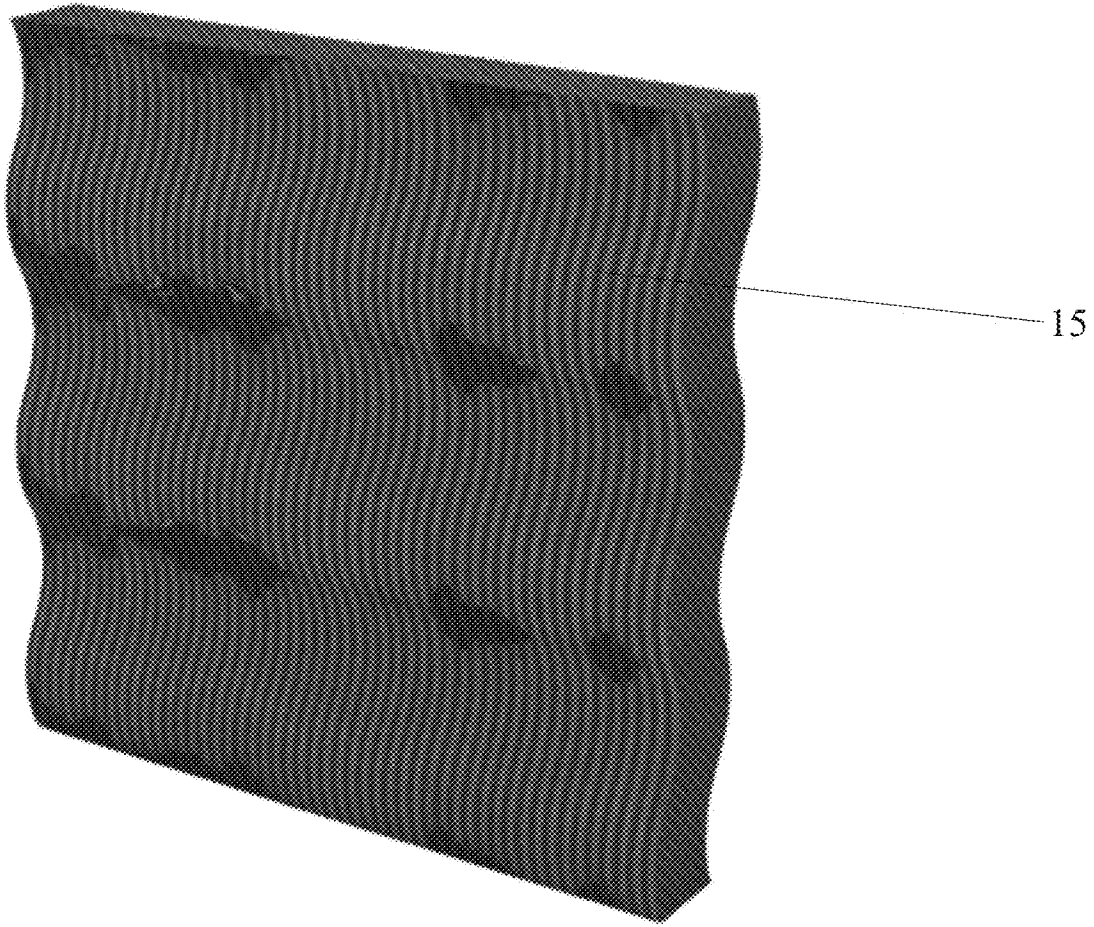
FIG. 10 shows the schematic view of the fillers.

FIG. 10 shows the schematic view of the fillers. In some embodiments, the modular wall frames are provided with fillers. FIG. 10 shows one kind of filler for this modular wall. Since the wall will be manufactured in a factory with multifunction devices set, a cushion filler with soundproofing function is convenient for assembly. This cushion filler has a wavy shape for disturbing the wave transmission through the wall. And the material of the cushion filler will be acoustic material to keep the wall soundproofing.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A modular wall assembly with prefabricated wires, comprising:

a base, which is provided with wires and extends out of the base, and at least one connecting groove and a plurality of convex rings are fixed on the base, and the connecting groove is provided with a plurality of conducting parts, and the conducting parts are in electrical communication with wires in the base; and multiple modular wall frames, each of the modular wall frames is provided with wires, and each modular wall frame comprising:

at least one connecting stud, which is provided on the bottom surface of the respective modular wall frame, and is provided with a plurality of lower conducting parts, and the lower conducting parts are in electrical communication with the wires in the respective modular wall frame;

at least one upper connecting groove, which is provided on the top surface of the respective modular wall frame and is provided with a plurality of upper conducting parts which are in electrical communication with the wires in the respective modular wall frame;

a plurality of upper convex rings, which are attached to the top surface of the respective modular wall frame;

a plurality of lower grooves, which correspond to the upper convex rings and are arranged on the bottom surface of the respective modular wall frame, and one side of the lower grooves is provided with a deep hole and the other side is symmetrically provided with a shallow hole; and a locking device, which is arranged in the bottom of the respective modular wall frame, and the locking device has a plurality of locking blocks, a transmission lever and an operating lever; the locking blocks correspond to the convex rings or the upper convex rings and are disposed in the deep holes, and each of the locking blocks extends upward with a connecting portion, and the connecting portion is provided with a first thread; the transmission lever is attached above the locking blocks, and is provided with a plurality of second threads corresponding to the first threads, so as to drive the locking blocks to perform linear motion through screw drive, and then inserted into the shallow holes after passing through the convex rings or the upper convex rings; the operating lever is connected with the transmission lever through gears for driving the transmission lever to rotate;

wherein, when one of the modular wall frames and the base is connected to each other, the at least one connecting stud is placed in the at least one connecting groove for the conducting parts and the lower conducting parts to be in electrical communication, thereby making the wires in the base electrically communicate with the wires in the one of modular wall frames, and the convex rings are inserted into the lower grooves for the locking blocks to fix the convex rings in the lower grooves after the operating lever is rotated, so that the one of the modular wall frames is fixed on the base;

wherein, when the one of the modular wall frames and another one of the modular wall frames are connected to each other, the at least one connecting stud is placed in the at least one upper connecting groove for the upper conducting parts and the lower conducting parts to be electrically connected, and then make the wires in the one of the modular wall frames electrically communicate with the wires in the another one of the modular wall frames, and the upper convex rings are inserted into the lower grooves for the locking blocks to fix the upper convex rings in the lower grooves after the operating lever is rotated, so that the one of the modular wall frames is fixed to the another one of the modular wall frames.

2. The modular wall assembly with prefabricated wires of claim 1, wherein opposing ends of the bottom surface of the modular wall frames are provided with an auxiliary connectors respectively, and opposing ends of the top surface of the modular wall frames are respectively provided with an upper auxiliary connecting groove corresponding to the auxiliary connectors, and opposing ends of the base are also provided with an auxiliary connection groove corresponding to the auxiliary connectors, so as to assist the connection of any of the modular wall frames to the base and the connection of the modular wall frames.

3. The modular wall assembly with prefabricated wires of claim 2, wherein the auxiliary connectors are rollers, and one end of the upper auxiliary connecting grooves and one end of the auxiliary connecting grooves are provided with a recess respectively for placing the auxiliary connectors.

4. The modular wall assembly with prefabricated wires of claim 3, wherein the modular wall frames are provided with at least one pillar, two ends of the at least one pillar are respectively connected to the top and the bottom of the modular wall frames, so as to allow the wires in the modular wall frames to connect to the lower conducting parts and the upper conducting parts.

5. The modular wall assembly with prefabricated wires of claim 4, wherein the at least one pillar is provided with an electrical contact hole which is in electrical communication with the wires in the modular wall frames for installing other electrical appliances at the modular wall frame.

6. The modular wall assembly with prefabricated wires of claim 5, wherein the transmission lever and the operating lever are arranged perpendicular to each other.

7. The modular wall assembly with prefabricated wires of claim 6, wherein the modular wall frames are provided with fillers.

8. The modular wall assembly with prefabricated wires of claim 7, wherein the base is screwed to floor.

9. The modular wall assembly with prefabricated wires of claim 8, further comprising a cover plate for covering the top of any one of the modular wall frames.

10. The modular wall assembly with prefabricated wires of claim 9, wherein the cover plate is screwed to ceiling.

11. The modular wall assembly with prefabricated wires of claim 10, further comprising shielding plates for enclosing the modular wall frames.

* * * * *